US006817084B2

(12) United States Patent
Tokusho et al.

(10) Patent No.: US 6,817,084 B2
(45) Date of Patent: Nov. 16, 2004

(54) METHOD FOR MANUFACTURING A SPEAKER APPARATUS

(75) Inventors: Takeshi Tokusho, Yamagata (JP); Yasuhisa Abe, Tendo (JP); Fumio Murayama, Tendo (JP)

(73) Assignees: Pioneer Electronic Corporation, Tokyo (JP); Tokuku Pioneer Electronic Corporation, Yamagata (JP)

( * ) Notice: Subject to any disclaimer, the term of this patent is extended or adjusted under 35 U.S.C. 154(b) by 368 days.

(21) Appl. No.: 10/036,368

(22) Filed: Jan. 7, 2002

(65) Prior Publication Data

US 2002/0064294 A1 May 30, 2002

Related U.S. Application Data

(62) Division of application No. 09/046,605, filed on Mar. 24, 1998, now Pat. No. 6,343,136.

(30) Foreign Application Priority Data

Mar. 25, 1997 (JP) ..... 9-90302

(51) Int. Cl.[7] ..... H04R 31/00

(52) U.S. Cl. ..... 29/594; 29/592.1; 29/609.1; 381/113; 381/116; 381/174; 381/191

(58) Field of Search ..... 29/592.1, 594, 29/609.1; 381/113, 116, 174, 191

(56) References Cited

U.S. PATENT DOCUMENTS

| | | | | |
|---|---|---|---|---|
| 2,084,945 A | | 6/1937 | Cornwell | 381/407 |
| 3,456,755 A | | 7/1969 | Walker | 381/398 |
| 3,801,943 A | | 4/1974 | Bertagni | 381/398 |
| 4,118,605 A | | 10/1978 | Kobayashi | 381/407 |
| 4,132,872 A | | 1/1979 | Inoue | 179/115.5 R |
| 4,387,275 A | | 6/1983 | Shimada et al. | 381/407 |
| 5,042,072 A | | 8/1991 | Button | 381/192 |
| 5,590,210 A | | 12/1996 | Matsuo et al. | 381/199 |
| 5,715,324 A | * | 2/1998 | Tanabe et al. | 381/412 |
| 5,734,132 A | | 3/1998 | Proni | 381/407 |
| 5,850,462 A | * | 12/1998 | Sakamoto et al. | 381/405 |
| 5,875,253 A | * | 2/1999 | Okazaki et al. | 381/396 |
| 5,933,508 A | | 8/1999 | Fuke et al. | 381/407 |

FOREIGN PATENT DOCUMENTS

JP 04296199 A * 10/1992 ..... H04R/9/04

OTHER PUBLICATIONS

"A high fidelity small–sized loudspeaker"; Satoh, K.; Takewa, H.; Iwasa, M.; Kikkawa, T.; Consumer Electronics, IEEE Transactions on , vol.: 43, Issue: 3, Aug. 1997; pp.: 972–979.*

* cited by examiner

*Primary Examiner*—A. Dexter Tugbang
*Assistant Examiner*—Paul D Kim
(74) *Attorney, Agent, or Firm*—Morgan, Lewis & Bockius LLP

(57) ABSTRACT

A method for manufacturing a speaker apparatus that includes fixing a magnetic circuit to a frame so that the magnetic circuit is positioned around a central hole of the frame; positioning a coil with respect to a center pole of the magnetic circuit; connecting a damper to the coil and the frame; positioning a jig in the central hole of the frame; projecting the jig from a center hole of the center pole; engaging a positioning portion provided on a diaphragm with the jig to position the diaphragm at a predetermined position with respect to the center pole, the positioning portion being removably connected with the jig positioned in the central hole of the frame to secure the position of the diaphragm relative to the magnetic circuit during the installation; and connecting the positioned diaphragm to the coil and the frame.

6 Claims, 14 Drawing Sheets

METHOD FOR MANUFACTURING A SPEAKER APPARATUS

This is a division of application Ser. No. 09/046,605 filed Mar. 24, 1998, now U.S. Pat. No. 6,343,136.

BACKGROUND OF THE INVENTION

1. Field of the Invention

This invention relates to a speaker apparatus and a manufacturing method thereof.

2. Discussion of the Related Art

In a speaker apparatus for converting electric signals to acoustic energy, a so called electrokinetic cone type speaker unit has conventionally been used.

FIG. 11 shows an example of such a speaker unit. Referring to FIG. 11, a cylindrical voice coil bobbin 103, around which voice coil 102 is wound, is provided at the center of a diaphragm 101 (cone) of the cone type speaker unit.

The diaphragm 101 and the voice coil bobbin 103 are fixed to one end of a ring-shaped edge 108 and a damper 109 having appropriate compliance and stiffness. The other ends of the edge 108 and damper 109 are fixed to a frame 112 equipped with a magnetic circuit 107, so that the frame 112 elastically supports the diaphragm 101 and voice coil bobbin 103.

The edge 108 and damper 109 support the voice coil 102 and voice coil bobbin 103 at respective predetermined positions in a magnetic gap of the magnetic circuit 107, which is constituted of a magnet 104, a plate 105, a pole yoke 106, and the like. With this structure, the diaphragm 101 is elastically supported without contacting the magnetic circuit 107 so as to be capable of vibrating like a piston in a predetermined direction within a predetermined amplitude range.

The leads of the voice coil 102 are connected to the respective ends of a pair of conductive lead wires 111. The other ends of the paired lead wires 111 are connected to a pair of terminals 110 provided on the frame 112.

Thus, when an electric current carrying acoustic signals is supplied from the terminals 110 to the voice coil 102 through the lead wires 111, the voice coil 102 is driven in the magnetic gap of the magnetic circuit 107 along the piston vibration direction of the diaphragm 101. As a result, the diaphragm 101 vibrates together with the voice coil 102 and voice coil bobbin 103, and converts the electric signals to acoustic energy, thereby producing acoustic waves.

A center cap 113 is fixed on the diaphragm 101 to cover a center hole at the center of the diaphragm 101, and moves integrally with the diaphragm 101. With this structure, the structural strength between the diaphragm 101 and voice coil 102 is intensified, thereby minimizing undesirable separate vibrations of diaphragm 101 and voice coil 102.

Further, because the center cap 113 vibrates integrally with the diaphragm 101, the center cap 113 also contributes to the generation of acoustic radiation power (mainly high frequency range) and also to phase correction of acoustic wave interference due to the shape of the diaphragm 101 by changing acoustic characteristics. Thus, the influences of the center hole of the diaphragm 101 on the acoustic characteristics can be corrected as desired.

The conventional electrokinetic cone speaker unit is constructed in the above manner and is manufactured by the manufacturing method shown in FIGS. 12A–12C and 13A–13D.

FIGS. 13A–13D show the manufacturing steps of the cone type speaker unit of FIG. 11. FIGS. 12A–12C show a preparatory process therefor.

First, the preparatory process will be described with reference to FIGS. 12A–12C. FIG. 12A is a cross-sectional view showing a structure of a coil gauge 114 with the preparatory process in which the coil gauge 114 is set in a frame assembly including the frame 112 and the magnetic circuit 107.

Referring to FIG. 12A, the coil gauge 114 is formed by bonding a cylindrical coil holding portion 114*b*, made of a resin film or the like and having a predetermined thickness, to a cylindrical surface of a main unit 114*a*, made of metal or the like.

The outer diameter D1 of the cylindrical surface of the main unit 114*a* (or inner diameter of the coil holding portion 114*b*) is substantially equal to the diameter of the center pole located at the center of the pole yoke 106. Accordingly, the coil gauge 114 is designed such that the coil holding portion 114*b* is removably fitted to the center pole of the pole yoke 106, as shown in FIG. 12C.

The outer diameter D2 of the coil holding portion 114*b* is substantially equal to the inner diameter D3 of the voice coil bobbin 103, as shown in FIG. 12B. Accordingly, the coil holding portion 114*b* is designed to hold the voice coil bobbin 103 in such a manner that the voice coil bobbin 103 can be removably fitted to the coil holding portion 114*b*.

As shown in FIG. 12B, the voice coil bobbin 103, having the voice coil 102 wound thereon, is fitted to the coil gauge 114. As shown in FIG. 12C, this coil gauge 114 is fitted to the center pole of the magnetic circuit 107. This completes the preparatory process.

As a result of the preparatory process above, voice coil bobbin 103 and voice coil 102 are held in the magnetic gap of the magnetic circuit 107 without contacting the center pole of the pole yoke 106 or the plate 105. Also, the positions of the voice coil bobbin 103 and the voice coil 102 relative to the pole yoke 106 and plate 105 are determined.

The next stage of the manufacturing process will be explained with reference to FIG. 13A to FIG. 13D. First, as shown in FIG. 13A, the damper 109 is placed at a predetermined position in the frame assembly. Then, the coil gauge 114, on which the voice coil bobbin 103 and voice coil 102 have been mounted in the preparatory process explained above is inserted into the center hole of the damper 109 and fitted to the center pole of the pole yoke 106.

Next, the inner circumference and the outer circumference of the damper 109 are fixed to the voice coil bobbin 103 and the frame assembly, respectively, with an adhesive agent. Here, the leads of the voice coil 102 are extracted to the upper side of the damper 109.

As shown in FIG. 13B, the diaphragm 101 having the edge 108 attached thereto is placed on the frame assembly, and the position of the diaphragm 101, relative to the voice coil 102, is fixed. Then, the outer circumference of the edge 108 is fixed to the frame assembly and the inner circumference of the diaphragm 101 is fixed to the voice coil bobbin 103 with an adhesive agent or the like. Because the motion of the voice coil bobbin 103 is restricted by the coil gauge 114, the relative positional relationship between the voice coil 102 and diaphragm 101 remains fixed during the attachment of the diaphragm 101.

As shown in FIG. 13C, each lead of the voice coil 102 is soldered to an eyelet on the diaphragm 101. The coil gauge 114 is then removed from the voice coil bobbin 103.

Next, the center cap 113 is fixed at the center of the diaphragm 101 with an adhesive agent, as shown in FIG. 13D. On the back side of the diaphragm 101, the ends of the voice coil 102 are connected to a pair of terminals 110 through the paired lead wires 111. The cone type speaker unit is thus completed.

As described above, during the manufacture of the cone type speaker unit, the relative positions of the diaphragm 101, damper 109, and voice coil bobbin 103 need to be fixed with high precision. Therefore, until the diaphragm 101 and damper 109 are fixed to the voice coil bobbin 103 with an adhesive agent, the coil gauge 114 is necessary. For this reason, a center hole slightly larger than the maximum diameter of the coil gauge 114 at the center of the diaphragm 101 must be created.

Because the structural strength of the diaphragm 101 is reduced by this center hole, the center cap 113 normally is used to reinforce the structure. However, to form the diaphragm 101 having high stiffness with a predetermined thickness, it is preferable to form the diaphragm 101 and the center cap 113 as one piece.

The diaphragm 101 needs to have a high stiffness and to radiate acoustic waves with the same or equivalent phases throughout its entire vibrating regions without interference. To satisfy this requirement, a single-piece integrated diaphragm, such as a flat diaphragm formed of high stiffness material, has been used.

FIGS. 14A–14C show part of the manufacturing process for such a flat speaker unit using the flat diaphragm. In the figures, the same reference numerals as in FIGS. 11–13D correspond to the same or like components.

As shown in FIG. 14A, a frame 115 for the flat speaker unit is installed on the magnetic circuit 107 to constitute a frame assembly. The damper 109 is placed at a predetermined position of the frame assembly. Then, the coil gauge 114, on which the voice coil bobbin 103 and voice coil 102 have been fitted in the preparatory process illustrated in FIGS. 12A–12C, is inserted into the center hole of the damper 109 and fitted to the center pole of pole yoke 106.

The inner circumference and the outer circumference of the damper 109 are fixed to the voice coil bobbin 103 and the frame assembly, respectively, with an adhesive agent. Here, the leads of the voice coil 102 are extracted to the upper side of the damper 109.

As shown in FIG. 14B, the leads of the voice coil 102 are connected to a pair of the terminals 110 through paired lead wires 111. The coil gauge 114 is then removed from the voice coil bobbin 103 having the damper 109 fixed thereto.

Next, as shown in FIG. 14C, a flat diaphragm 117 having an edge 116 attached thereto is placed on the frame assembly and is placed at a predetermined position relative to the voice coil 102. Then, the outer circumference of the edge 116 is attached to the frame assembly with an adhesive agent, and the back side of the diaphragm 117 is attached to the voice coil bobbin 103.

Unlike the cone type speaker unit described above in this case, the flat diaphragm 117 is used, and thus, it is not necessary to reinforce the diaphragm with the center cap 113.

As described above, connection of the lead wires 111 in the flat speaker unit is carried out before the diaphragm 117 installed. In the case of the cone type speaker unit above, because the diaphragm 101 is formed to be cone-shaped, a sufficient space is provided to allow connection work of the lead wires 111 in the back of the diaphragm 101 even after the diaphragm 101 is fixed. However, if the flat speaker unit is manufactured using the same method, the diaphragm 117 is flat shaped. Therefore, a gap between the diaphragm 117 and damper 109 is much narrower, and connection work of the lead wires 111 is difficult.

However, in this type of speaker unit, as described above, the coil gauge 114 is removed and the diaphragm 117 is positioned and fixed to the voice coil bobbin 103 that is floatably supported by the damper 109 in the installation process. Thus, the voice coil bobbin 103 and diaphragm 117 can move during the installation work of the diaphragm. Therefore, they may not be fixed with a desired positional relationship.

As a result, the relative position between the voice coil 102 of the speaker unit and magnetic circuit 107 may change and/or the voice coil 102 and voice coil bobbin 103 may contact the pole yoke in a gap of the magnetic circuit 107. In such cases, electric signals supplied to the voice coil 102 cannot be efficiently converted into acoustic energy to reproduce sound.

Therefore, in the manufacture of the conventional flat speaker units, the compliances of the damper 109 and edge 116 should be limited within an appropriate range to facilitate the installation process of the voice coil bobbin 103 and diaphragm 117.

However, the compliances of the damper 109 and edge 116 need to have larger values when the low frequency reproduction range is to be expanded by lowering the minimum resonance frequency ($f_0$) of the flat speaker unit Also, damper 109 and edge 116 need to have large compliances in order to raise the acoustic pressure of the diaphragm 117 by enlarging the vibration range (amplitude) of the voice coil 102. That is, the larger compliances are necessary to improve acoustic characteristics, such as reproduction frequency range of the flat speaker unit, maximum acoustic pressure, and the like. However, as long as the above-mentioned manufacturing method is used, there is a limit in setting of the compliances of the damper 109 and edge 116, and therefore, it is difficult to improve the acoustic characteristics of the speaker unit.

SUMMARY OF THE INVENTION

Accordingly, present invention is directed to a speaker apparatus and a manufacturing method thereof that substantially obviate the problems due to limitations and disadvantages of the related art.

An object of the present invention is to provide a speaker apparatus having excellent acoustic characteristics and a simpler manufacturing method therefor.

Additional features and advantages of the invention will be set forth in the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a speaker apparatus including a diaphragm and a magnetic circuit, wherein the diaphragm has a positioning portion for positioning the diaphragm relative to the magnetic circuit.

In another aspect, the present invention provides a speaker apparatus including a diaphragm; a magnetic circuit; and a positioning member fixed to the diaphragm for positioning the diaphragm relative to the magnetic circuit.

In another aspect, the present invention provides a method for manufacturing a speaker apparatus including the steps of fixing a magnetic circuit to a frame; positioning a coil with respect to a center pole of the magnetic circuit; connecting a damper to the coil and the frame; projecting a jig from a center bole of the center pole; engaging a positioning portion provided on a diaphragm with the jig to position the diaphragm at a predetermined position with respect to the center pole; and connecting the positioned diaphragm to the coil and the frame.

In another aspect, the present invention provides a method for manufacturing a speaker apparatus including the steps of fixing a magnetic circuit to a frame; positioning a coil with respect to a center pole of the magnetic circuit; connecting a damper to the coil and the frame; projecting a jig from a center hole of the center pole; engaging a positioning member with the jig for positioning the diaphragm at a predetermined position with respect to the center pole; fixing the diaphragm to the positioning member, and connecting the diaphragm fixed in the step of fixing to the coil and the frame.

In another aspect, the present invention provides a speaker apparatus including a frame having a magnetic circuit; a voice coil bobbin installed in the frame to be magnetically coupled to the magnetic circuit; and a diaphragm movably installed in the frame and fixed to the voice coil bobbin so as to be driven by activating the magnetic circuit, the diaphragm further having a positioning portion used for securing the diaphragm relative to the magnetic circuit during an installation of the diaphragm in the frame.

In a further aspect, the present invention provides a speaker apparatus including a frame having a magnetic circuit; a voice coil bobbin installed in the frame to be magnetically coupled to the magnetic circuit of the frame; and a diaphragm movably installed in the frame; and a support member connecting the diaphragm to the voice coil bobbin, the support member having a positioning portion used for securing a predetermined position of the diaphragm relative to the magnetic circuit during an installation of the diaphragm in the frame.

Because the present invention is so constructed as described above, the diaphragm can be securely positioned relative to the magnetic circuit. Further, the installation process of the coil and diaphragm can be carried out while the diaphragm is positioned at a predetermined position relative to the coil.

Thus, a speaker apparatus, in which the coil and diaphragm are positioned with respect to the magnetic circuit with high accuracy, can be produced easily. As compared with the conventional speaker apparatus, in which the entire diaphragm is integrally formed, the speaker apparatus of the present invention has superior acoustic characteristics.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
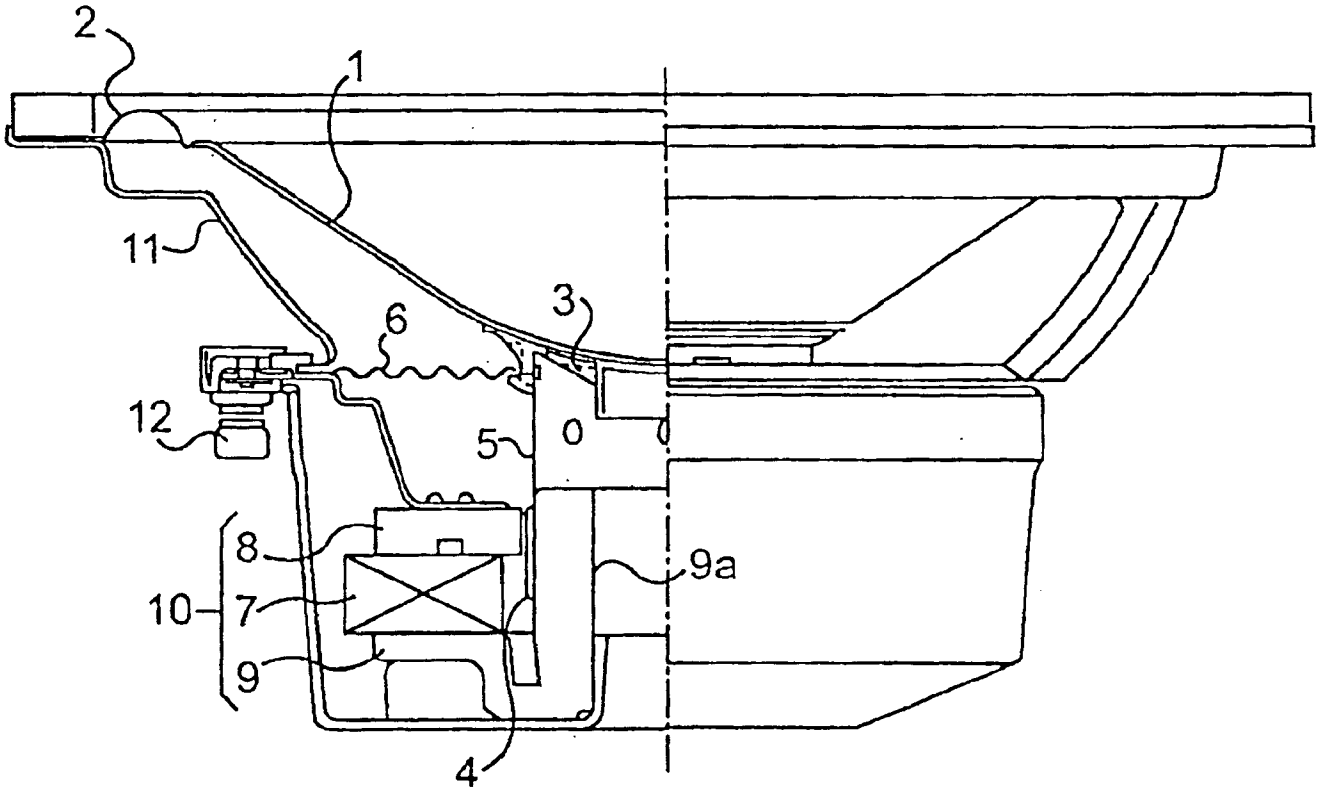
FIG. 1 schematically shows an example of a speaker apparatus according to a preferred embodiment of the present invention.

FIG. 1 is a cross-sectional view of main portions of an electrokinetic cone type speaker unit according to a preferred embodiment of the present invention. Referring to FIG. 1, a diaphragm 1 is formed by integral formation of paper or resin into a parabolic shape having a substantially uniform thickness.

As a result, the diaphragm 1 has a closed form having a substantially circular region, to the circumference of which a ring-like edge 2 having appropriate compliance and stiffness is attached. That is, unlike conventional types, the diaphragm 1 has no opening portion through which a voice coil bobbin is to be inserted.

A holder 3 formed of ABS resin or the like is fixed to the diaphragm 1 near the center at the back side of the diaphragm 1. The holder 3 is fixed to a voice coil assembly (hereinafter referred to as coil) in which a voice coil 4 is wound around a cylindrical voice coil bobbin 5. Thus, the holder 3 is integrally constructed with the diaphragm 1, voice coil 4, and voice coil bobbin 5.

The holder 3 and the voice coil bobbin 5 are fixed to the inner circumference of a ring-like damper 6 having appropriate compliance and stiffness. The outer circumferences of the edge 2 and damper 6 are respectively fixed to a frame 11 equipped with a magnetic circuit 10 including a magnet 7, a plate 8, and a pole yoke 9, etc.

The pole yoke 9, part of the magnetic circuit 10, has a substantially cylindrical center pole in the center of a circular plate on which the magnet 7 is placed. A cylindrical center hole 9*a*, coaxial with the center pole, is formed in the center pole.

The edge 2 and the damper 6 have respective cross-sections suitable for obtaining a predetermined amplitude and for elastically supporting the diaphragm 1, holder 3, voice coil 4 and voice coil bobbin 5. Thus, the edge 2 and the damper 6 position the voice coil 4 and voice coil bobbin 5 at respective predetermined positions in a magnetic gap of the magnetic circuit 10 so as not to contact the magnetic circuit 10. The edge 2 and the damper 6 also elastically support the diaphragm 1 so that the diaphragm 1 can vibrate in a predetermined direction within a predetermined amplitude range like a piston.

The leads of the voice coil are connected to the respective ends of a pair of supply lines (not shown in FIG. 1) provided on the damper 6, and the other ends of the paired supply lines are electrically connected to a pair of terminals 12 on the frame 11.

Thus, when an electric current carrying acoustic signals is supplied from the terminals 12 to the voice coil 4 through the supply lines, the voice coil 4 is driven along the piston vibration direction within a magnetic gap of the magnetic circuit 10. As a result, the diaphragm 1 vibrates together with the holder 3, voice coil 4, and voice coil bobbin 5 to convert the electric signals to acoustic energy, thereby producing acoustic waves.

Figure 2A:
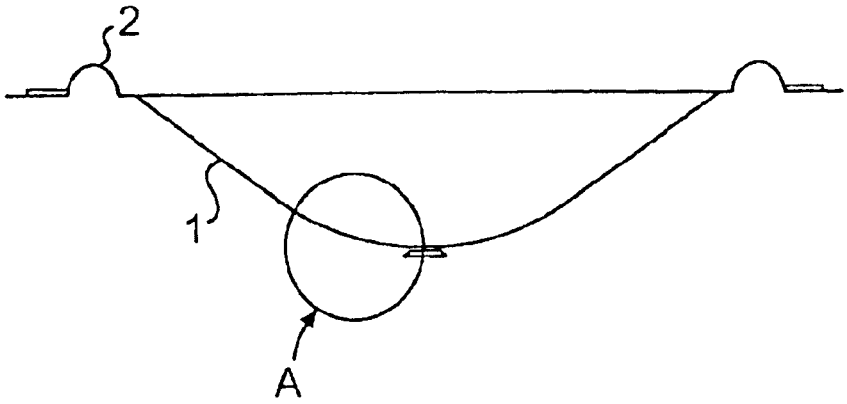
FIGS. 2A, 2B are cross-sectional views showing an example of a diaphragm according to the present invention.
Figure 2B:
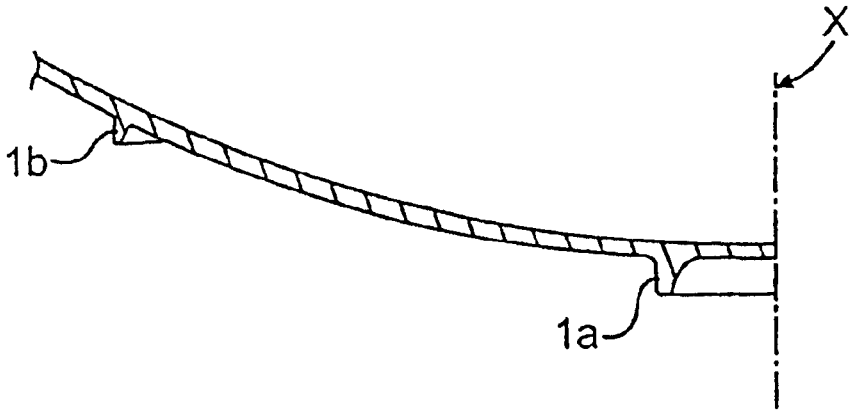

A detailed structure of the cone type speaker unit will now be described. First, the diaphragm 1 is described in more detail. FIGS. 2A and 2B arc cross-sectional views showing an example of the diaphragm 1 with the edge 2 attached. FIG. 2B shows an enlarged view of a portion of FIG. 2A indicated by the arrow A. As shown in FIG. 2B, holder mounting portions 1*a*, 1*b*, each shaped into a ring-like protrusion, are provided on the back side of the diaphragm 1. The holder mounting portions 1*a*, 1*b* are coaxial with the center axis X of the diaphragm 1.

Figure 3A:
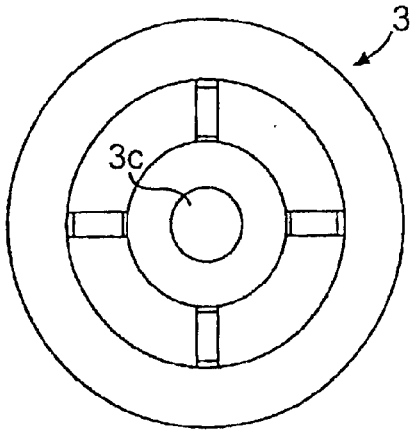
FIGS. 3A–3D schematically shows an example of a holder according to the present invention.
Figure 3B:
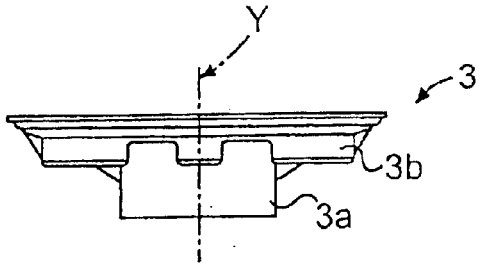
Figure 3C:
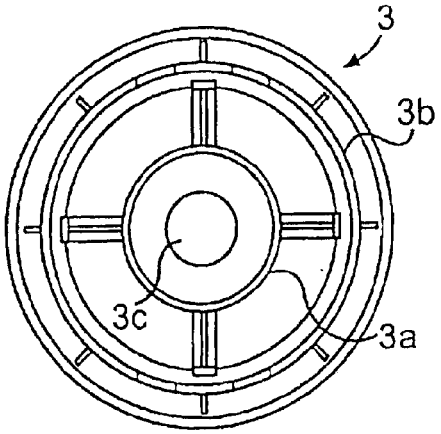
Figure 3D:
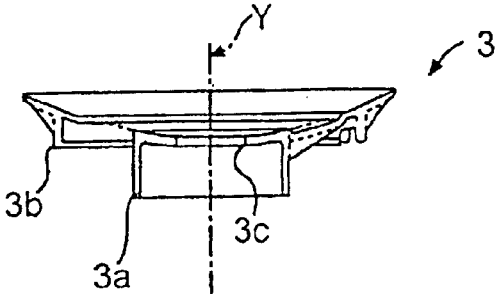

The holder 3 will be described in more detail. FIGS. 3A–3D are structural diagrams showing an example of the holder 3. FIG. 3A is a top view, FIG. 3B is a side view, FIG. 3C is a bottom view, and FIG. 3D is a side sectional view.

As shown in FIGS. 3A–3D, ring-like protruding guides 3*a*, 3*b* and a circular guide hole 3*c* are provided coaxially with the center axis Y at the back side of the holder 3. The inner surface of the guide 3*a* is designed such that a jig 14 for use in a subsequent manufacturing process (which will be described later) can be removably attached to the guide 3*a*.

The guide 3*b* is designed such that the inner surface thereof can engage with the voice coil bobbin 5. Further, the guide hole 3*c* is provided to engage with the holder mounting portion 1*a* of the diaphragm 1. The maximum outer diameter of the holder 3 is designed such that the holder 3 can be mounted at a region of the diaphragm surrounded by the holder mounting portion 1*b*.

Figure 4:
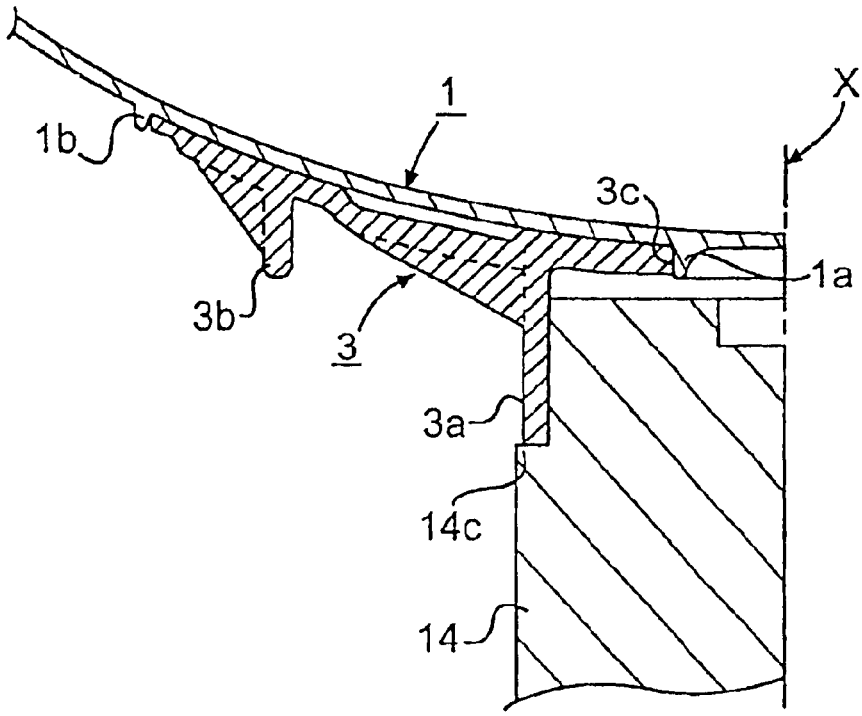
FIG. 4 shows a state in which a diaphragm and a jig are engaged with a holder according to the present invention.

FIG. 4 shows a state in which diaphragm 1 and jig 14 are fitted to the holder 3. As shown in FIG. 4, the contact surfaces between the diaphragm 1 and holder 3 are designed to be firmly fitted to each other when the guide hole 3*c* is engaged with the holder mounting portion 1*a*.

The diaphragm 1 and the holder 3 are bonded to each other with an adhesive agent. The holder mounting portion 1*b* also prevents leakage of the adhesive agent, and therefore, serves to suppress asymmetry in weight balance of the diaphragm 1 relative to the center axis X that may occur without it.

When the diaphragm 1 and the holder 3 are bonded to each other as shown in FIG. 4, the center axis X of the diaphragm 1 should coincide with the center axis Y of the holder 3, so that the diaphragm 1 and the holder 3 maintain the coaxial relation with high accuracy.

Figure 5A:
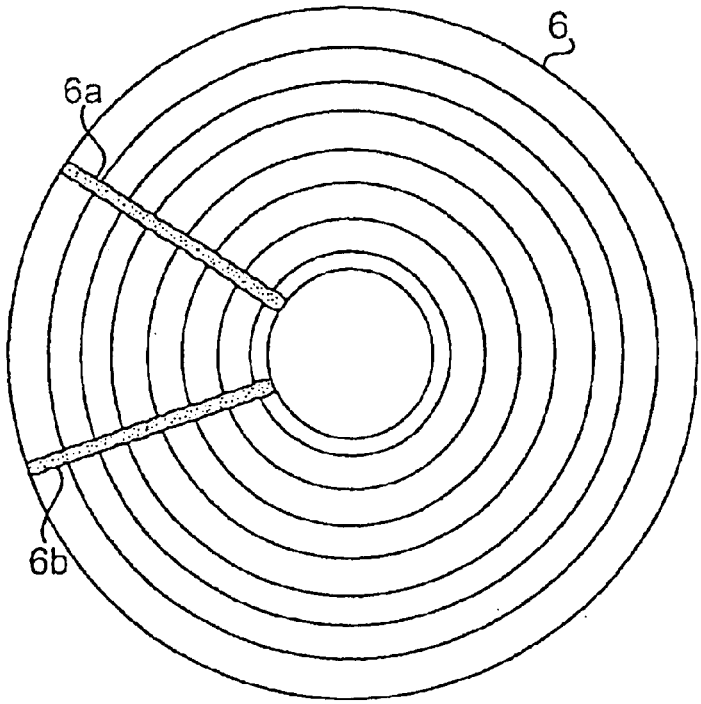
FIGS. 5A and 5B schematically show an example of a damper according to the present invention.
Figure 5B:
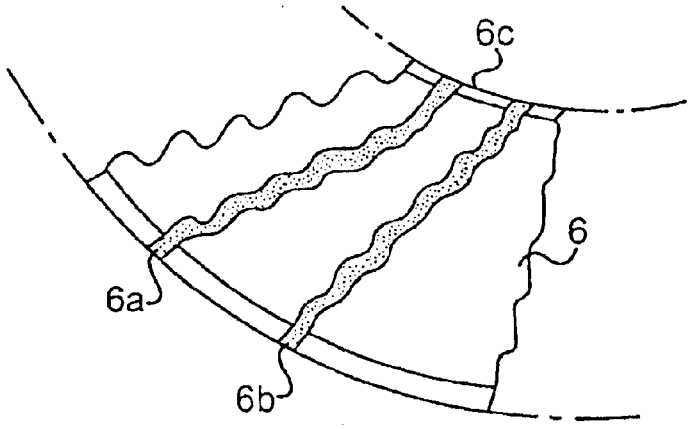

Next, the damper 6 will be described in more detail. FIGS. 5A and 5B show an example of the damper 6. FIG. 5A shows a top view and FIG. 5B shows a perspective view illustrating a part of damper 6. The damper 6 has a ring-like shape and is a so-called corrugation damper. A pair of conductive supply lines 6*a*, 6*b* made of copper foil or the like are attached to the surface of the damper 6. To form the corrugation damper, resin or the like is immersed in cloth and coaxial corrugation is formed by heating the cloth, for example.

The supply lines 6*a*, 6*b* may be disposed radially along the coaxial unevenness with an adhesive agent, damping agent, or the like, after resin is immersed in the cloth and the corrugation is formed by a heat treatment. The supply lines 6*a*, 6*b* also may be preliminarily attached to cloth before the corrugation is formed by heating. Further, a center hole 6*c* for allowing the coil to pass through is provided at the center of the damper 6.

A method for manufacturing the cone type speaker unit according to a preferred embodiment of the present invention will be described below.

Figure 6A:
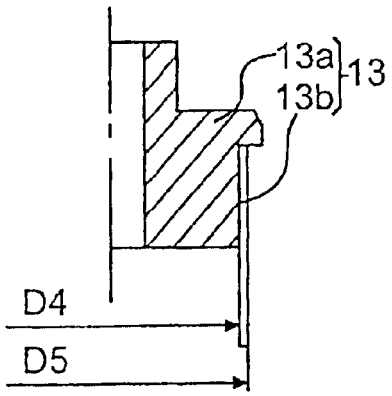
FIGS. 6A–6C show an example of a method for manufacturing the cone type speaker unit according to a preferred embodiment of the present invention (preparatory process for the steps shown in FIGS. 7A–7C)
Figure 6B:
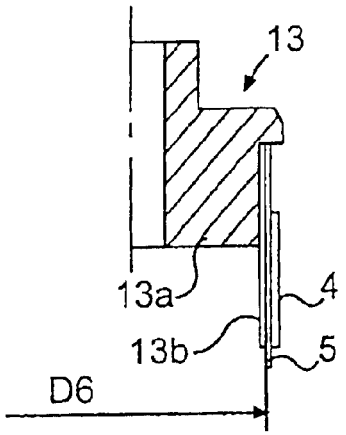
Figure 6C:
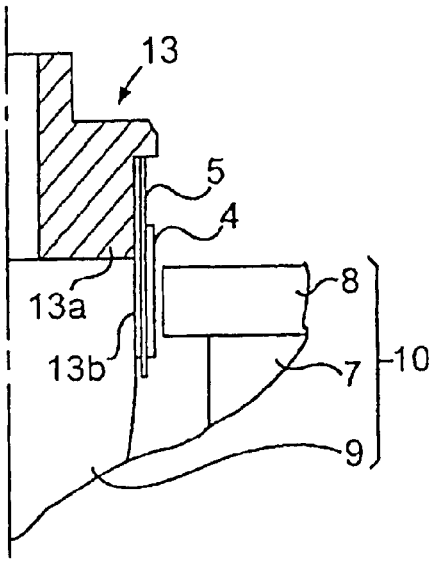

FIGS. 6A–6B and FIGS. 7A–7C show an example of a method for manufacturing the cone type speaker unit according to the preferred embodiment of the present invention. FIGS. 6A–6C show a preparatory process for the subsequent process shown in FIGS. 7A–7C.

FIGS. 6A–6C are cross-sectional views showing the structure of the coil gauge 13 and the preparatory process for installing the coil gauge 13 on a frame assembly constituted of the frame 11 and the magnetic circuit 10.

FIG. 6A shows a structure of the coil gauge 13. Like the coil gauge 114 in FIGS. 12A–13B, the coil gauge 13 has a cylindrical coil holding portion 13*b* made of resin or the like, having a predetermined thickness, and a main unit 13*a* made of metal, for example, having a cylindrical surface.

The outer diameter D4 of the cylindrical surface of the main unit 13*a* (or inner diameter of the coil holding portion 13*b*) is substantially equal to the diameter of the center pole located at the center of the pole yoke 9. The coil gauge 13 is designed such that the coil holding portion 13*b* can be removably fitted to the center pole of the pole yoke 9, as shown in FIG. 6C.

The outer diameter D5 of the holding portion 13*b* is substantially equal to the inner diameter D6 of the voice coil bobbin 5, as shown in FIG. 6B. When engaged, the voice coil bobbin 5 can be removably fitted to the coil holding portion 13*b*.

As shown in FIG. 6B, the voice coil bobbin 5 having the voice coil 4 wound thereon is fitted to the coil gauge 13. Next, as shown in FIG. 6C, this coil gauge 13 is fitted to the center pole of the magnetic circuit 10 so that coil bobbin 5 is securely held. As a result, the voice coil bobbin 5 and voice coil 4 are held in the magnetic gap of the magnetic circuit 10 so as not to be in contact with the center pole of the pole yoke 9 or the plate 8. The positions of the voice coil bobbin 5 and voice coil 4 relative to the pole yoke 9 and plate 8 are also fixed at respective predetermined positions. This completes the preparatory process.

Figure 7A:
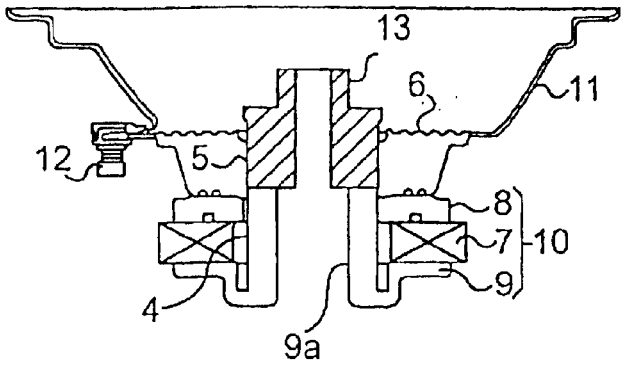
FIGS. 7A–7C show an example of a method for manufacturing the cone type speaker unit according to a preferred embodiment of the present invention.

The next stage of the manufacturing process will be explained with reference to FIGS. 7A–7C. First, the damper 6 is placed at a predetermined position of the frame assembly, as shown in FIG. 7A. Then, the coil gauge 13 on which the coil has been mounted in the preparatory process shown in FIGS. 6A–6C is inserted into the center hole 6*c* of the damper 6. The coil gauge 13 is fitted to the center pole of the pole yoke 9 so that the coil is secured at a predetermined position.

Next, the inner circumference and the outer circumference of the damper 6 are bonded to the voice coil bobbin 5 and the frame assembly, respectively, with an adhesive agent. Here, the leads of the voice coil 4 are extracted to the upper side of the damper 6.

After the damper 6 is fixed to the voice coil bobbin 5 and the frame assembly, the supply lines 6*a*, 6*b* are electrically connected to the voice coil 4 near the center hole 6*c* of the damper 6. The other ends (outer side of the damper 6) of the paired supply lines 6*a*, 6*b* are electrically connected to a pair of terminals 12 mounted on the frame 11.

In this condition, diaphragm 1 has not been installed yet Therefore, unlike the conventional case described above, connection work of the supply lines 6*a*, 6*b* to the terminals 12 need not be carried out in a narrow space between the damper and the diaphragm. Further, this connection work can be done with the voice coil bobbin 5 fixed to the coil gauge 13, and therefore the work can be executed easily, stably, and securely.

After the supply lines 6*a*, 6*b* are connected to the voice coil 4 and the terminals 12, the coil gauge 13 is removed from the voice coil bobbin 5.

Figure 7B:
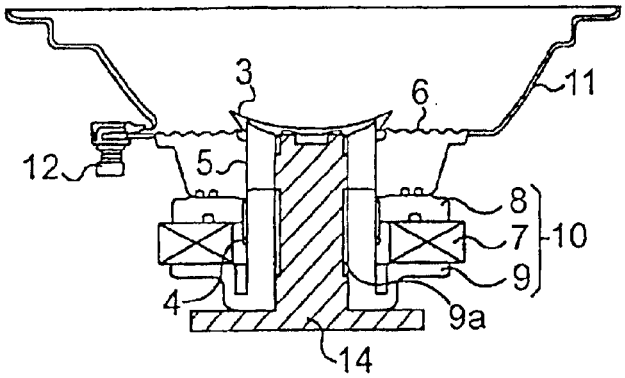

Next, as shown in FIG. 7B, the jig 14 is inserted into the center hole 9*a* from the bottom of the pole yoke 9, and the top of the jig 14 is projected from the center pole.

Figure 8:
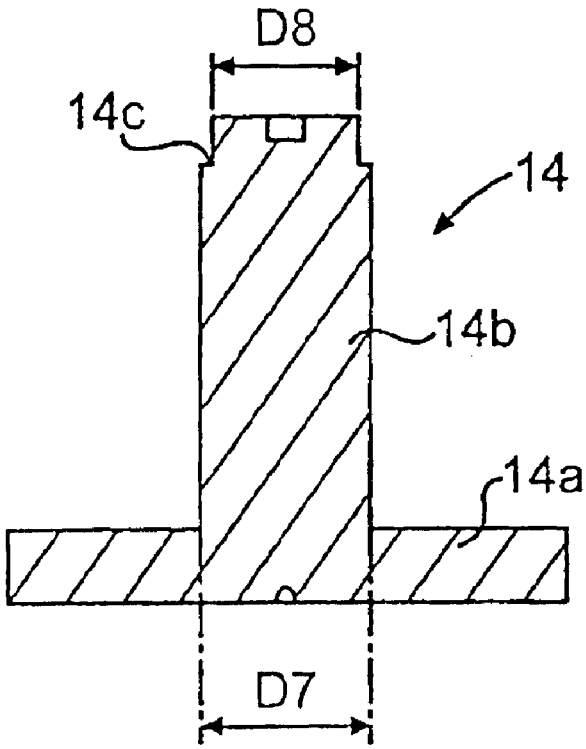
FIG. 8 is a schematic cross-sectional view of a jig for use in the manufacture of the cone type speaker unit according to a preferred embodiment of the present invention.

FIG. 8 schematically shows the cross-section of jig 14. The jig 14 is formed of material having excellent wear resistance, processing precision, and processability, such as "DERLIN." A cylindrical standing portion 14*b* having a predetermined height is integrally provided at the center of a circular base 14*a*.

The diameter D7 of the standing portion 14*b* near the base 14*a* is so designed as to allow the standing portion 14*b* to be detachably fitted to the center hole 9*a* of the pole yoke 9. The diameter D8 near the top of the standing portion 14*b* is so designed that the inner face of the guide 3*a* of the holder 3 (FIG. 4) can be detachably fitted to the top of the standing portion 14*b*.

The standing portion 14*b* has a step portion 14*c* having an edge parallel to the base 14*a*. As shown in FIG. 4, when the inner face of the guide 3*a* of the holder 3 engages with the standing portion 14*b*, the step portion 14*c* comes into contact with the bottom of the guide 3*a* to support the holder 3.

In FIG. 7B, the jig 14 protrudes from the center pole of the pole yoke 9. An adhesive agent is applied to the inner circumference of the damper 6 and the side face of the voice coil bobbin 5 projecting from the damper 6. Then, the guide 3*a* of the holder 3 is engaged with the standing portion 14*b* to be placed on the step portion 14*c*. As a result while the coil is positioned at a predetermined position relative to the magnetic circuit 10 shown in FIG. 7A, the guide 3*a* is supported by the step portion 14*c* and the guide 3*b* is fixed to the damper 6 and coil.

Figure 7C:
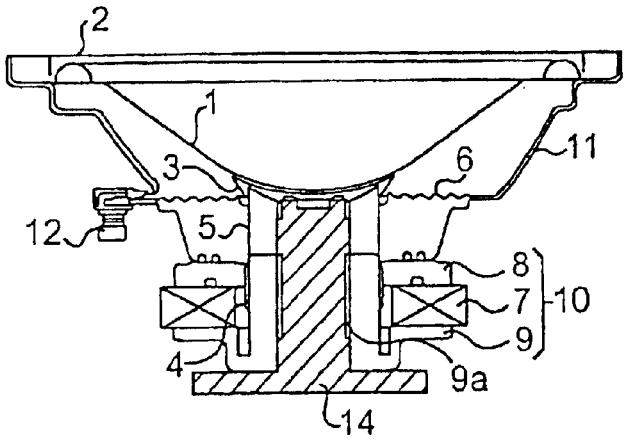

Referring to FIG. 7C, a portion of the frame assembly to which the edge 2 is to be attached and a portion of the surface of the holder 3 to which the diaphragm 1 is to be attached are coated with an adhesive agent. Then, the diaphragm 1 (see FIG. 2) having the edge 2 attached thereto is placed from above. The holder mounting portion 1*a* of the diaphragm 1 is engaged with the center hole 3*c* of the holder 3 to define the position of diaphragm 1 relative to the holder 3 (FIG. 4). The outer circumference of the edge 2 is fixed to the frame assembly. As a result, the diaphragm 1 is positioned at a predetermined position and fixed to the holder 3. Then, the jig 14 is removed from the holder 3 and pulled out from the center hole 9*a*. The cone type speaker unit of the present embodiment is thus completed.

Although in this embodiment the diaphragm 1 is structured entirely in closed curvature within a substantially circular range to which the edge 2 is attached, the above-described method is not restricted to this example. That is, as long as the diaphragm 1 is provided with the guides 1*a*, 1*b*, or the like, for positioning the diaphragm relative to the magnetic circuit during the manufacture of the speaker apparatus, the diaphragm 1 may have an even opening portion. Further, it is permissible to provide the diaphragm with an opening and then close the opening after assembly.

Although in the embodiment described above the diaphragm 1 is fixed to the holder 3 after the damper 6 and voice the coil 4 are fixed to the holder 3, it is permissible to first fix the diaphragm 1 to the holder 3 and then fix the damper 6 and the voice coil 4 to the holder 3.

Further, the holder 3 may be integrated with the diaphragm 1 with the guides 1*a*, 1*b*. In this case, the step of fixing the holder 3 to the diaphragm 1 is omitted.

Although in the embodiment described above the center cap is not provided, it is permissible to so construct with the center cap as in the prior art, if desired. In this case, the process for attaching the center cap may be provided any time after the step of installing the diaphragm.

Figure 9A:
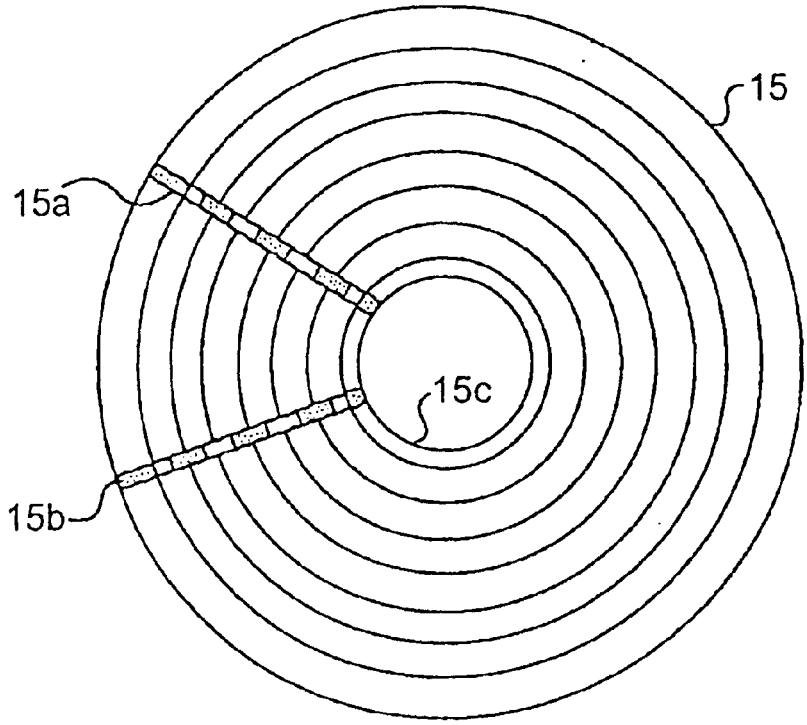
FIGS. 9A and 9B schematically show another example of the damper for use in the speaker apparatus of the present invention.
Figure 9B:
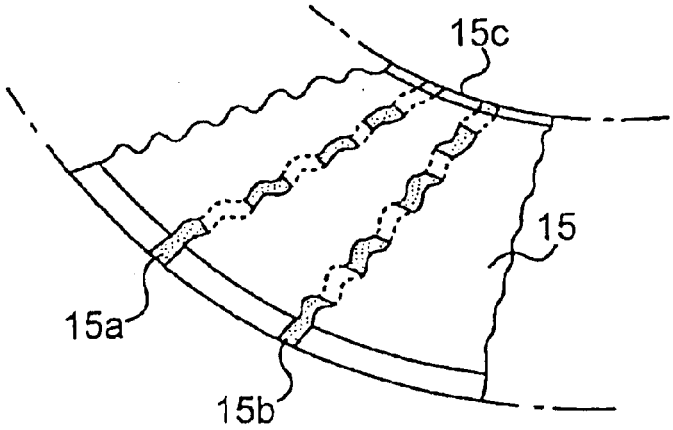

Although the paired supply lines 6*a*, 6*b* on the damper 6 of the cone type speaker unit are formed on the surface of the corrugation damper formed of cloth with a heat treatment, the present invention is not restricted to this example. FIGS. 9A, 9B show another example of damper 15 for use in the speaker apparatus according to the present invention. FIG. 9A shows a top view and FIG. 9B shows a perspective view showing a part of the damper. As shown in FIGS. 9A, 9B, the paired supply lines 15*a*, 15*b* may be woven in the cloth.

Figure 10:
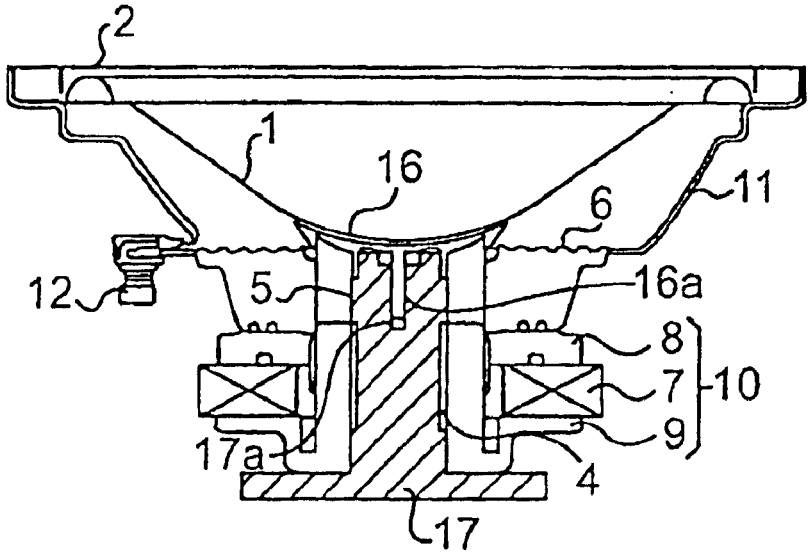
FIG. 10 schematically shows a state in which a holder and a jig of the cone type speaker unit according to another preferred embodiment of the present invention are engaged with each other.
Figure 11:
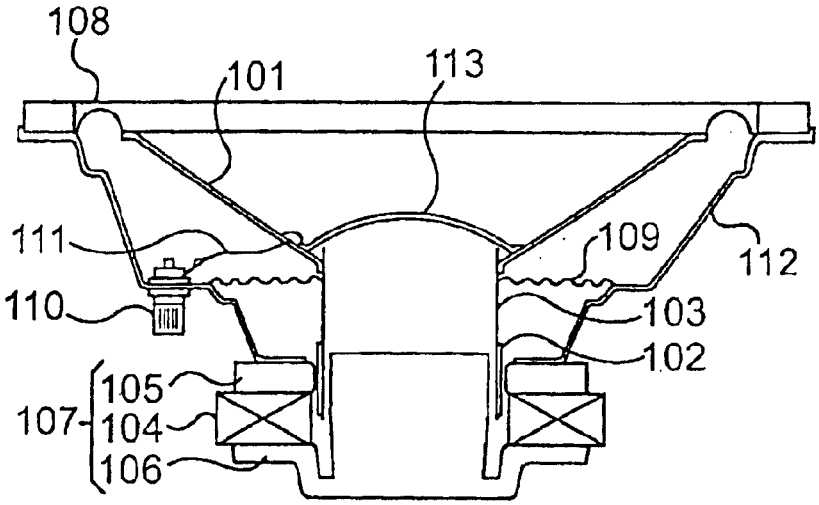
FIG. 11 PRIOR ART
FIG. 11 is a diagram showing an example of a conventional electrokinetic cone type speaker unit.
Figure 12A:
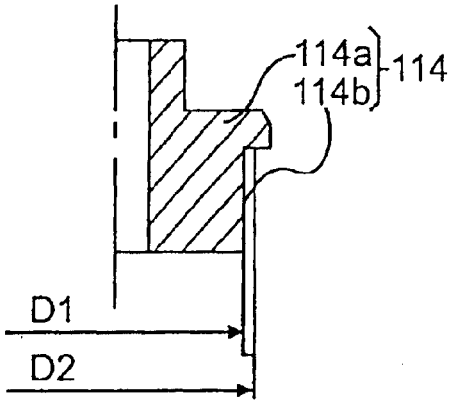
FIG. 12A PRIOR ART
FIGS. 12A–12C show a method of manufacturing the conventional electrokinetic cone type speaker unit (preparatory process for the steps shown in FIGS. 13A–13D)
Figure 12B:
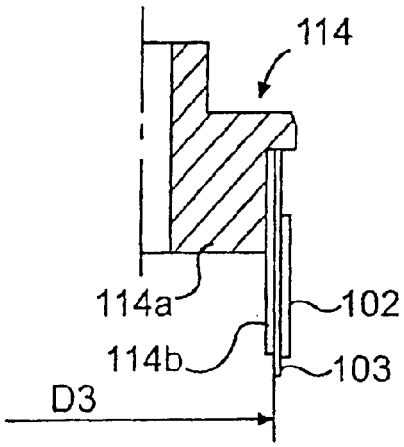
FIG. 12B PRIOR ART
Figure 12C:
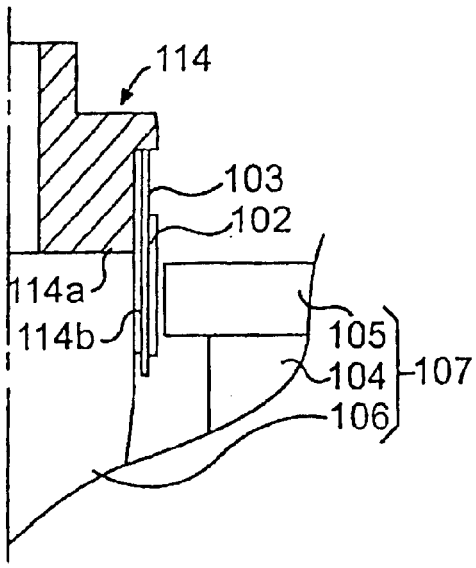
FIG. 12C PRIOR ART
Figure 13A:
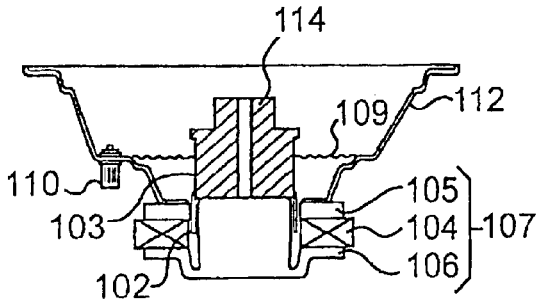
FIG. 13A PRIOR ART
FIGS. 13A–13D show a method for manufacturing the conventional electrokinetic cone type speaker unit.
Figure 13B:
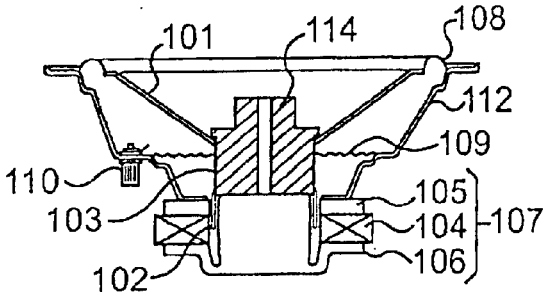
FIG. 13B PRIOR ART
Figure 13C:
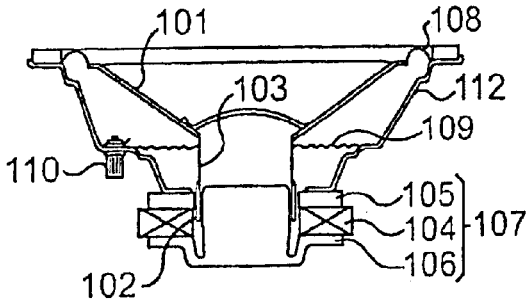
FIG. 13C PRIOR ART
Figure 13D:
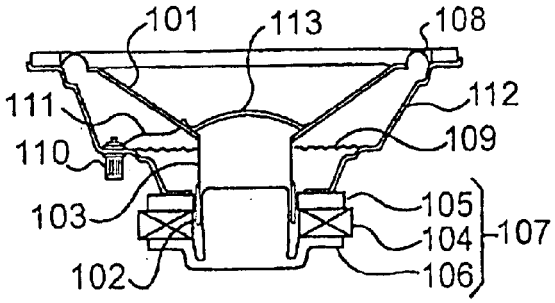
FIG. 13D PRIOR ART
Figure 14A:
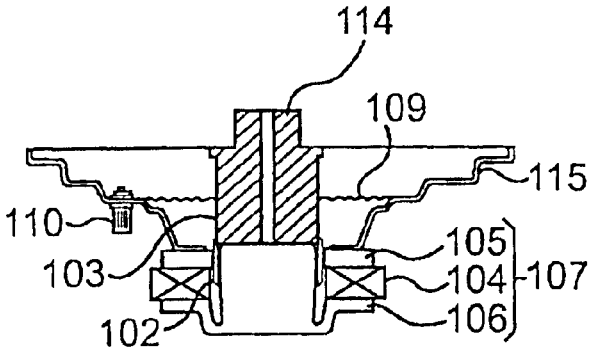
FIG. 14A PRIOR ART
FIGS. 14A–14C show an example of a conventional flat speaker unit using a flat diaphragm and part of the manufacturing process thereof.
Figure 14B:
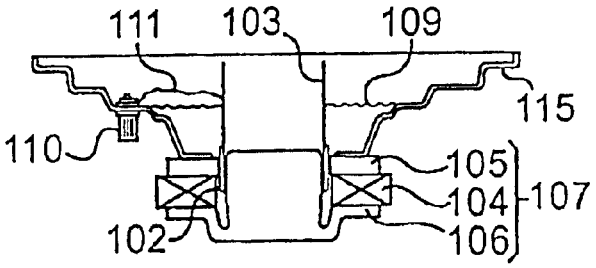
FIG. 14B PRIOR ART
Figure 14C:
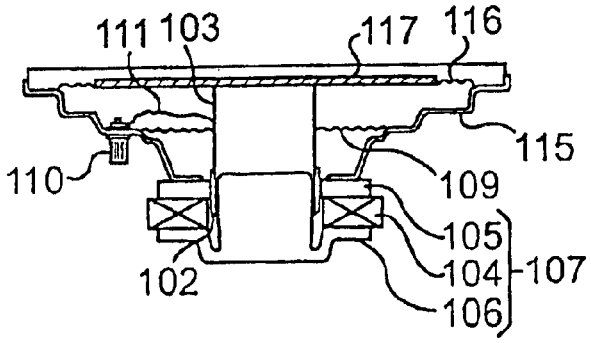
FIG. 14C PRIOR ART

In the embodiments described above, holder 3 and jig 14 are designed such that the standing portion 14*b* is inserted into the interior of the guide 3*a* provided at the back side of the holder 3. However, as shown in FIG. 10, holder 16 may be supported by jig 17 at a predetermined position by engaging an additional protrusion 16*a* of the holder 16 (fixed to the diaphragm 1) with a recessed portion 17*a* of the jig 17, for example.

In this case, the area of the engagement between the protrusion 16*a* and the recessed portion 17*a* can be increased as desired. Thus, the jig 17 is capable of supporting the holder 16 more stably. As shown in FIG. 10, the holder 16 is so constructed to have the protrusion 16*a* at the center instead of the guide hole 3*c* of the holder 3. The jig 17 has the recessed portion 17*a*, which is not provided in the jig 14.

If the holder 16 and jig 17 are used in the manufacturing process of the speaker apparatus, the height of the guide (corresponding to the guide 3*b* of the holder 3) of the holder 16 that engages with the voice coil bobbin 5 need not be so large to support the holder. Therefore, the additional weight can be minimized, while the effective radiation area of the diaphragm of the speaker apparatus remains unchanged, thereby achieving a higher acoustic conversion efficiency.

With the present invention described above, the diaphragm can be securely positioned relative to the magnetic circuit. Further, fixing work for the coil and diaphragm can be carried out without sacrificing accuracy of the designed positional relation between the coil and diaphragm. Thus, a speaker apparatus, in which the coil and diaphragm are excellently positioned with respect to the magnetic circuit, can easily be manufactured. Furthermore, when the one-piece diaphragm of the present invention is used, as compared with the conventional speaker apparatus in which the entire diaphragm is integrally formed, the speaker apparatus of the present invention provides much superior acoustic characteristics.

It will be apparent to those skilled in the art that various modifications and variations can be made in the speaker apparatus and production method thereof of the present invention without departing from the spirit or scope of the invention. Thus, it is intended that the present invention cover the modifications and variations of this invention provided they come within the scope of the appended claims and their equivalents.

What is claimed is:

1. A method for manufacturing a speaker apparatus comprising the steps of:

fixing a magnetic circuit to a frame so that the magnetic circuit is positioned around a central hole of the frame;

positioning a coil with respect to a center pole of the magnetic circuit;

connecting a damper to the coil and the frame;

positioning a jig in the central hole of the frame;

projecting the jig from a center hole of the center pole;

engaging a positioning portion provided on a diaphragm with the jig to position the diaphragm at a predetermined position with respect to the center pole, the positioning portion being removably connected with the jig positioned in the central hole of the frame to secure the position of the diaphragm relative to the magnetic circuit during the installation; and connecting the positioned diaphragm to the coil and the frame.

2. The method according to claim 1, further comprising the step of electrically connecting an electricity supply portion of the damper to the coil.

3. The method according to claim 1, wherein a center cap is formed integrally with the diaphragm.

4. A method for manufacturing a speaker apparatus comprising the steps of:

fixing a magnetic circuit to a frame so that the magnetic circuit is positioned around a central hole of the frame;

positioning a coil with respect to a center pole of the magnetic circuit;

connecting a damper to the coil and the frame;

positioning a jig in the central hole of the frame;

projecting the jig from a center hole of the center pole;

engaging a positioning member with the jig for positioning the diaphragm at a predetermined position with respect to the center pole, the positioning member being removably connected with the jig positioned in the central hole of the frame to secure the position of the diaphragm relative to the magnetic circuit during the installation;

fixing the diaphragm to the positioning member; and connecting the fixed diaphragm to the coil and the frame.

5. The method according to claim 4, further comprising the step of electrically connecting an electricity supply portion of the damper to the coil.

6. The method for producing a speaker apparatus according to claim 4, wherein a center cap is formed integrally with the diaphragm.

* * * * *